US010625825B1

(12) United States Patent
Schwarz

(10) Patent No.: US 10,625,825 B1
(45) Date of Patent: Apr. 21, 2020

(54) CHAFE GUARD ASSEMBLY FOR A WATERCRAFT MOORING LINE

(71) Applicant: Line Defenders, LLC, Austin, TX (US)

(72) Inventor: Magic Schwarz, Austin, TX (US)

(73) Assignee: Line Defenders, LLC, Austin, TX (US)

( * ) Notice: Subject to any disclaimer, the term of this patent is extended or adjusted under 35 U.S.C. 154(b) by 0 days.

(21) Appl. No.: 16/042,499

(22) Filed: Jul. 23, 2018

Related U.S. Application Data

(60) Provisional application No. 62/536,057, filed on Jul. 24, 2017.

(51) Int. Cl.
*B63B 21/00* (2006.01)
*B63B 21/04* (2006.01)
*B63B 21/20* (2006.01)

(52) U.S. Cl.
CPC ..... *B63B 21/04* (2013.01); *B63B 21/20* (2013.01); *B63B 2021/203* (2013.01); *D07B 2201/2084* (2013.01); *D07B 2201/20903* (2015.07)

(58) Field of Classification Search
CPC ..... B63B 21/00; B63B 21/04; B63B 21/08; B63B 21/20; B63B 2021/00; B63B 2021/003; B63B 2021/005; B63B 2021/203; D07B 2201/2084; D07B 2201/20903
USPC ..... 114/230.2, 230.26, 230.28
See application file for complete search history.

(56) References Cited

U.S. PATENT DOCUMENTS

| | | | | |
|---|---|---|---|---|
| 2,546,396 | A | 3/1951 | Jenkins | |
| 2,875,721 | A | 3/1959 | Downey | |
| 3,117,371 | A | 1/1964 | Farley | |
| 4,258,608 | A * | 3/1981 | Brown | D04C 1/12 114/215 |
| 4,534,262 | A * | 8/1985 | Swenson | D04C 1/12 57/210 |
| 4,639,977 | A * | 2/1987 | Howard | B60P 7/0869 24/129 B |
| 5,441,790 | A * | 8/1995 | Ratigan | B32B 7/08 428/100 |
| 7,717,053 | B2 * | 5/2010 | Jayne | B63B 21/00 114/230.1 |
| 8,333,162 | B2 | 12/2012 | Chapman et al. | |
| 8,502,069 | B2 * | 8/2013 | Holland | B65D 63/00 139/383 R |
| 8,807,060 | B2 | 8/2014 | Parish et al. | |

(Continued)

*Primary Examiner* — Daniel V Venne
(74) *Attorney, Agent, or Firm* — Hall Estill Attorneys at Law

(57) ABSTRACT

Apparatus and method for mooring a watercraft to a stationary attachment point such as a dock. A guard assembly reduces chafing between a mooring line and an edge surface of the watercraft using an elongated tube of flexible material through which a medial portion of the mooring line freely passes. A securement strap of the guard assembly extends from a proximal end of the tube and is configured for attachment to an attachment point of the watercraft, such as a cleat. The securement strap has a length sufficient to maintain a medial portion of the tube in interposed relation between the mooring line and the edge surface of the watercraft. The securement strap may be adjustable in length to accommodate different watercraft configurations.

20 Claims, 3 Drawing Sheets

(56) References Cited

U.S. PATENT DOCUMENTS

| | | | | |
|---|---|---|---|---|
| 8,950,350 | B2 * | 2/2015 | Merrill | B63B 21/20 114/230.2 |
| 9,003,993 | B1 | 4/2015 | Ratigan | |
| 9,010,265 | B1 * | 4/2015 | Ratigan | B63B 21/20 114/230.2 |
| 9,499,236 | B1 | 11/2016 | Arlet | |
| 2008/0314304 | A1 * | 12/2008 | Jayne | B63B 21/00 114/230.17 |
| 2015/0266546 | A1 | 9/2015 | Petersen et al. | |

* cited by examiner

CHAFE GUARD ASSEMBLY FOR A WATERCRAFT MOORING LINE

RELATED APPLICATION

The present application makes a claim of domestic priority to U.S. Provisional Patent Application No. 62/536,057 filed Jul. 24, 2017, the contents of which are hereby incorporated by reference.

BACKGROUND

Mooring lines are often used to secure watercraft (e.g., boats, ships, etc.) to a support structure such as a dock, buoy, anchor, etc. Mooring lines should be provided with sufficient strength and durability to withstand the large tensile loads normally associated with maintaining a watercraft in a secured position. While smaller scale mooring lines are usually formed of nylon or synthetic rope, other constructions can include metal lines, chains, etc.

Specially configured attachment points such as cleats are often provided along the respective sides of a typical watercraft at various bow, side and aft locations to facilitate attachment of one or more mooring lines as required. To moor a watercraft, a first end of a mooring line can be attached to an associated cleat on the craft, and the opposing second end of the mooring line can be passed across for attachment to the support structure, such as a second cleat on a dock.

Because the cleats or other attachment points of a watercraft are usually at a higher elevation than the attachment points on the support structure, the mooring line(s) will usually tend to wrap over a side edge of the watercraft and extend downwardly to the fixed support structure. This can present a number of issues, including chafing or other damage as the mooring line(s) contact the edge of the watercraft.

SUMMARY

Various embodiments of the present disclosure are generally directed to an apparatus and method for mooring a watercraft to a stationary support structure, such as a dock.

In some embodiments, a chafe guard assembly is provided to reduce chafing between a mooring line and an edge surface of a watercraft. The chafe guard assembly includes an elongated tube of flexible material having opposing proximal and distal ends and an innermost diameter sized to accommodate passage of a first end of the mooring line therethrough. A securement strap extends from the proximal end of the tube, and is configured to be attached to an attachment point of the watercraft. The securement strap has a length selected to locate a medial portion of the tube in contacting engagement with the edge surface of the watercraft. This reduces wear upon the edge surface by the mooring line responsive to attachment of the first end of the mooring line to the attachment point and attachment of an opposing second end of the mooring line to a fixed support structure adjacent the watercraft.

These and other features and advantages of various embodiments can be understood with a review of the following detailed description in conjunction with the accompanying drawings.

BRIEF DESCRIPTION OF DRAWINGS

FIG. 10 shows the mooring line guard formed from the layer of material in

FIG. 9.

DETAILED DESCRIPTION

Various embodiments of the present disclosure are generally directed to a mooring line guard for a watercraft. As explained below, some embodiments provide the mooring line guard, also referred to herein as a guard, a chafe guard assembly or a guard assembly, with an elongated tube of flexible material having opposing proximal and distal ends. The tube has an innermost diameter sized to accommodate passage of the mooring line therethrough from the proximal end to the distal end.

The guard further includes a securement strap which extends from the proximal end of the tube. The securement strap forms a loop to facilitate attachment of the tube to an attachment point of the watercraft, such as a cleat used to secure a first end of the mooring line. The tube and the strap are sized such that a medial portion of the tube will extend between the mooring line and an edge surface of the watercraft.

It is contemplated that the mooring line and the guard will each be separately attached to the watercraft attachment point, and the mooring line will be configured to freely slide within the tube. In some embodiments, the effective length of the securement strap can also be lengthened or shortened. In this way, the tube can be efficiently and repeatedly positioned in an optimal position to cushion the edge surface of the watercraft and prevent contact thereof with the mooring line. In further embodiments, a protection pad is additionally provided which can be slipped over the cleat or other attachment point under the exposed portion of the mooring line, thereby providing a layer of protective material between the mooring line and the watercraft.

Figure 1:
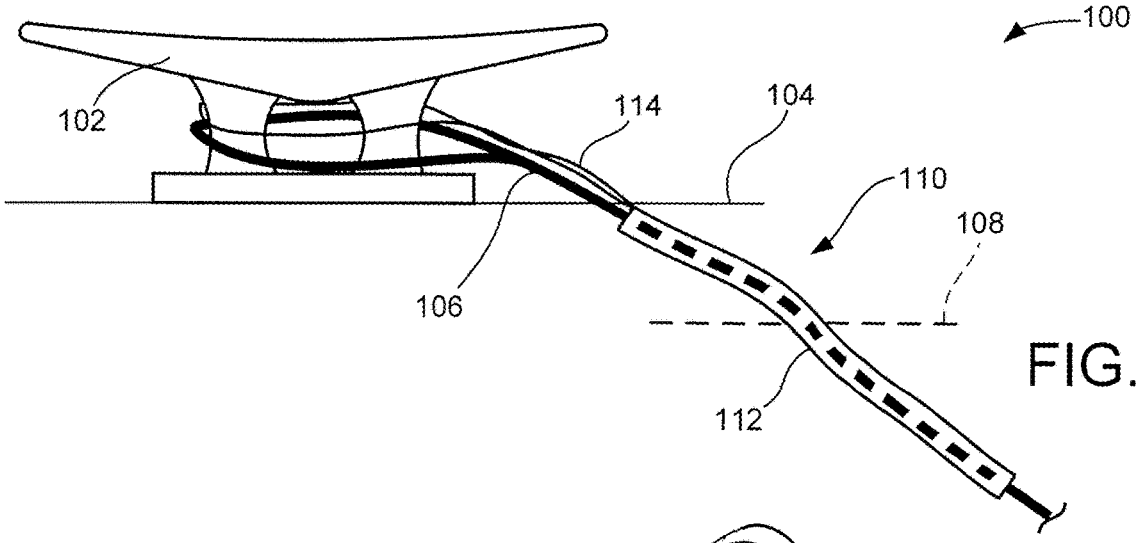
FIG. 1 provides a schematic representation of a watercraft mooring system constructed and operated in accordance with various embodiments of the present disclosure, the watercraft mooring system also sometimes referred to as a chafe guard apparatus.

These and other features and advantages of various embodiments can be understood from a review of the drawings, beginning with FIG. 1 which provides a schematic depiction of a mooring line protection system for a watercraft 100. The mooring line protection system is also sometimes referred to as a watercraft mooring system and a chafe guard apparatus. The watercraft can take any number of different forms of marine or aquatic vessels, such as boats, ships, personal watercraft, etc.).

The watercraft 100 includes an attachment point 102. As will be recognized, the exemplary attachment point is characterized as a horn cleat attached to a deck surface 104 of the watercraft. The cleat 102 has respective horns which project upwardly and outwardly from a narrowed base portion to facilitate the wrapping and tying of a mooring line 106 thereto. In the present illustration, the mooring line 106 is formed of rope and terminates in a permanent loop that is sized to be slipped over the cleat at such times that the watercraft is to be moored to a nearby support structure (e.g., a dock, etc.).

An edge surface of the watercraft 100 is represented by dotted line 108. It will be understood that the edge surface 108 may be at the same elevation as, or at a different elevation from, the elevation of the deck 104. Regardless, passage of the mooring line (hereinafter "rope") 106 over the edge surface 108 and down to the support structure could induce wear, chafing or other damage to the edge surface and/or rope.

Accordingly, FIG. 1 further shows a mooring line guard 110 constructed in accordance with various embodiments to protect the edge surface from such wear, chafing and other damage. As explained below, the mooring line guard, also sometimes referred to as a guard, a chafe guard assembly or a guard assembly 110, includes a protective tube 112 and a securement strap 114. Generally, the protective tube 112 is formed of a durable, flexible material and is sized to allow sliding passage of the rope 106 therethrough while cushioning the edge surface from contact with the rope. The strap 114 slips over or is otherwise attached to the cleat 102 to maintain the relative position of the tube 112. Once the mooring line is pulled taut, it is contemplated that the tube will remain in the relative position indicated in FIG. 1, even if the watercraft shifts position relative to the support structure over time.

Figure 2:
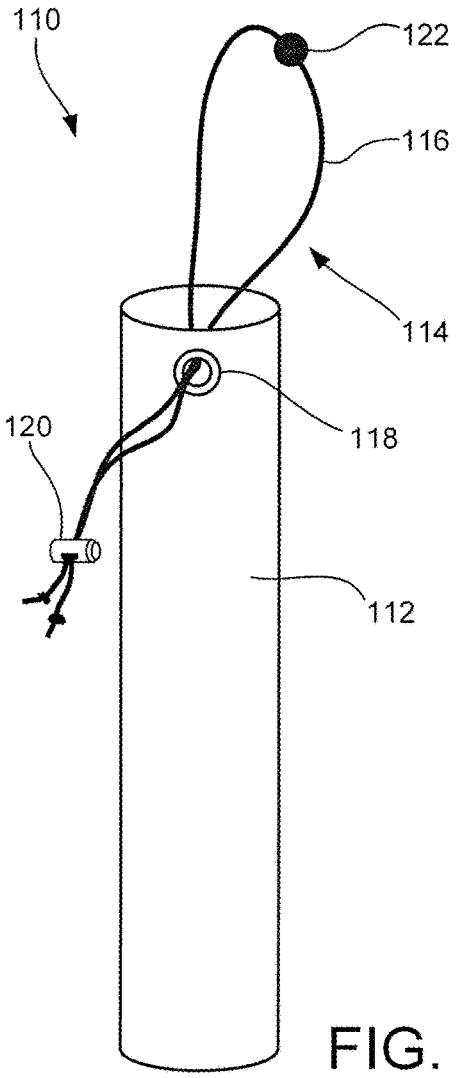
FIG. 2 is a schematic representation of a mooring line guard of FIG. 1 in accordance with some embodiments, the mooring line guard also sometimes referred to as a chafe guard assembly.

FIG. 2 shows an example construction for the guard assembly 110 in accordance with some embodiments. Other configurations can be used so that the construction is merely exemplary and not limiting.

The tube 112 in FIG. 2 is formed of neoprene, polychloroprene or other synthetic rubber material. The tube has opposing proximal and distal ends separated by any suitable length. In one embodiment, the tube is approximately 20 inches in length, although other sizes can be used. The tube 112 has a diameter sized to facilitate passage of a first end of the rope 106 (see FIG. 1) therethrough. Use of neoprene or similar material is particularly suitable as the material is somewhat elastomeric and can stretch as required to allow passage of the rope while thereafter allowing relative sliding movement of the rope within the tube. It will be appreciated that any number of different types of materials can be used, including water impermeable, durable and flexible materials. Examples include but are not limited to woven or matted fabrics such as canvas, rubber or rubberized fabrics, plastics, etc.

The securement strap 114 is formed from an elongated cord 116 such as nylon paracord which is routed as shown through an aperture extending through a brass grommet 118. The cord can be any suitable length depending on the requirements of a given application. In one embodiment, the cord is about 36 inches long, so that the doubled loop has an effective length of a little less than 18 inches. Other sizes and lengths can be used as required. The brass grommet 118 provides a reinforced area to reduce tearing of the tube material due to tensile forces during use.

A securement member such as a spring clip 120 can be used to enable the user to shorten or lengthen the effective overall length of the cord 116. In other embodiments, a glass bead or similar retention member can be used. The securement member is configured to, when activated, secure the two ends of the cord 116 at a suitable location, and is sized such that the securement member will not pass through the aperture in the grommet 118. A bead 122 can be slipped over the cord on the opposite side of the grommet to ensure that the loop 114 does not inadvertently pass through the grommet and become detached from the tube 112.

Figure 3:
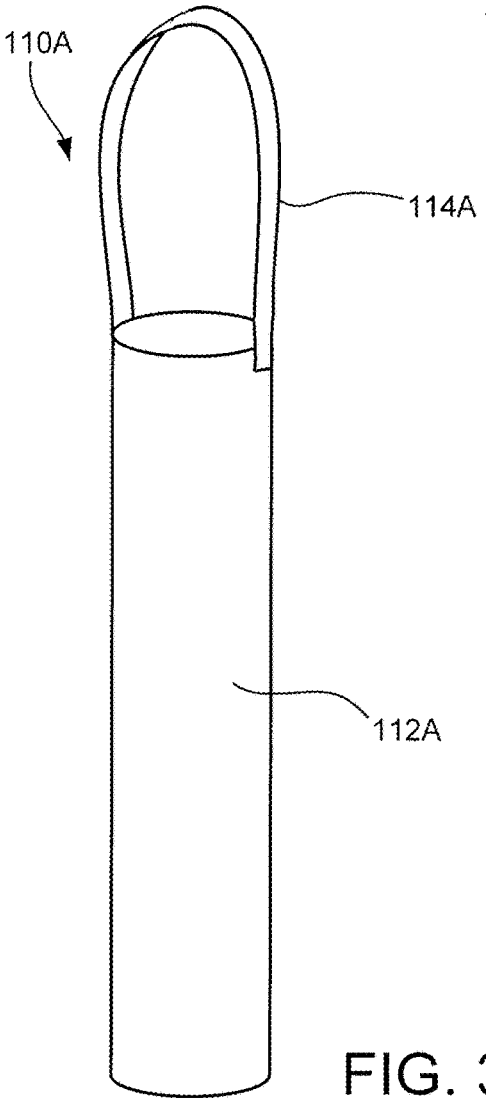
FIG. 3 shows another mooring line guard in accordance with further embodiments.

FIG. 3 shows another alternative embodiment for the guard assembly. Denoted as 110A, the guard assembly includes a neoprene or similar tube 112A and a securement strap 114A. As before, the securement strap is formed of neoprene or other durable and flexible material. The strap 114A is also formed of the same material. Opposing ends of the strap 114A are sewn or otherwise attached to the proximal end of the tube as shown.

Figure 4:
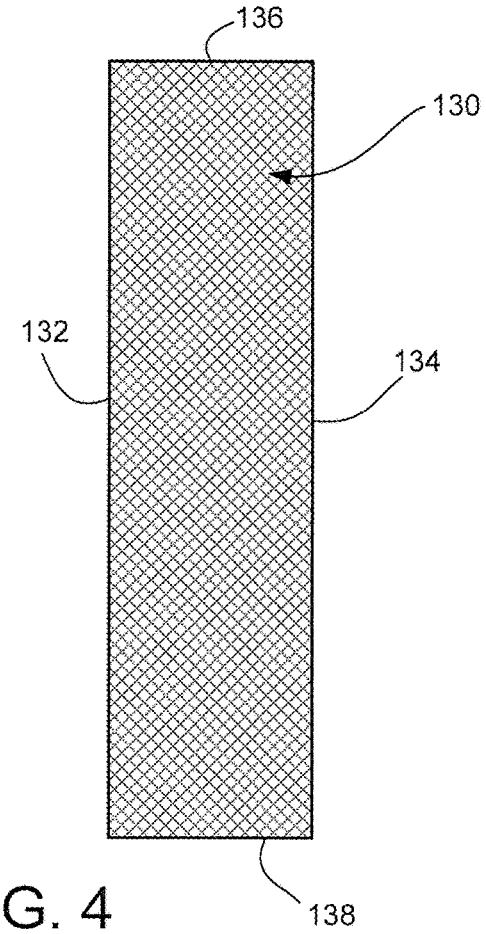
FIG. 4 illustrates a layer of material used to form a mooring line guard in some embodiments.
Figure 5:
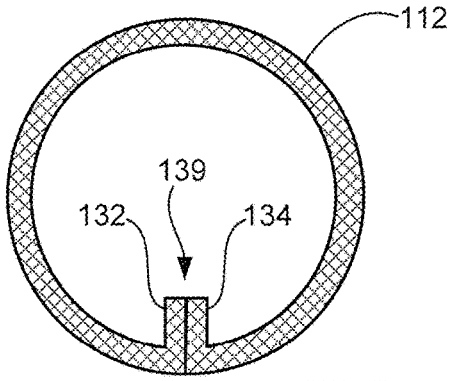
FIG. 5 shows an end view of the layer of material formed into a tube of the mooring line guard.

FIG. 4 shows a sheet of neoprene material 130 to illustrate the construction of the tube 112 in some embodiments. The material is rectangular in shape with opposing side edges 132, 134 and opposing ends 136, 138. The opposing side edges 132, 134 are brought together and sewn or otherwise attached along the length thereof to form a seam 139, after which the tube material 130 is turned inside out to provide the final tube configuration as shown in FIG. 5.

Figure 6:
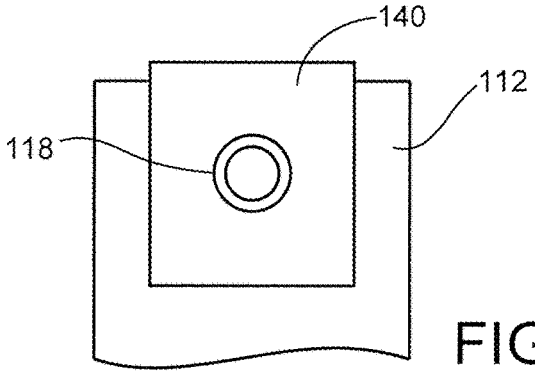
FIG. 6 illustrates a rivet assembly used to form an aperture for a strap portion of the mooring line guard.
Figure 7:
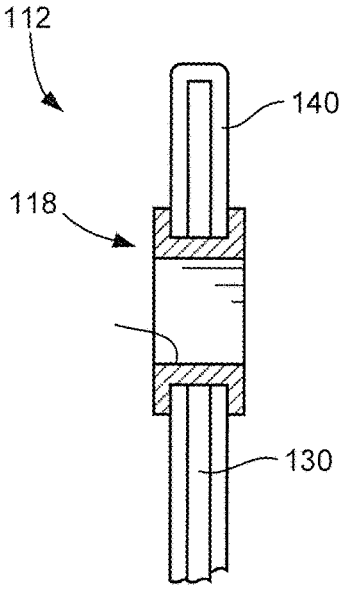
FIG. 7 is a cross-sectional depiction of FIG. 6.

FIG. 6 shows a reinforcing layer 140 of canvas or other tear resistant fabric that is provided in the vicinity of the proximal end of the tube (e.g., adjacent top edge 136 from FIG. 4). The layer 140 can be folded over the top edge 136 allowing the grommet 118 to pass through both the neoprene material 130 as well as the double layers of the canvas, as depicted in FIG. 7. Alternatively, only a single layer of the reinforcing material may be used.

Figure 8:
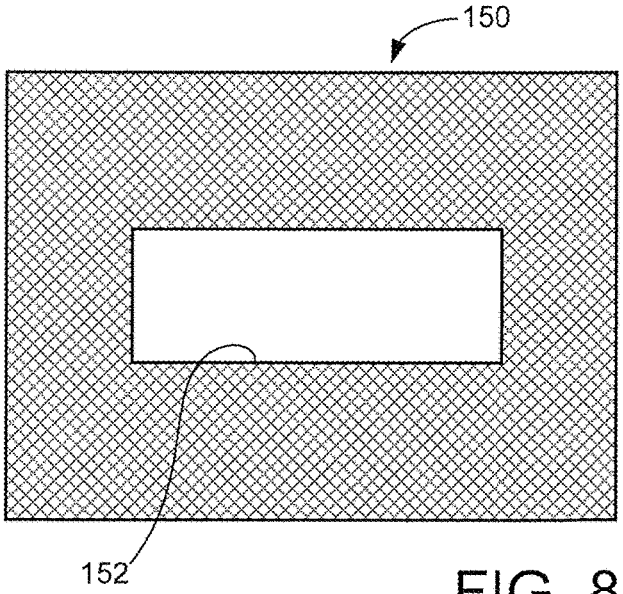
FIG. 8 shows a protection pad that may be utilized in conjunction with the mooring line guard in further embodiments.

FIG. 8 shows a top plan view of a protective pad 150 that may be utilized in accordance with further embodiments. The pad is rectangular in shape and includes a rectangular central aperture 152. The pad 150 is sized to slip over the cleat 102 or other attachment point on the watercraft 100 to provide further protection between the rope 106 and the deck surface 106. As with the tube 112, the pad 150 may also be formed of neoprene or any other suitable material.

Figure 9:
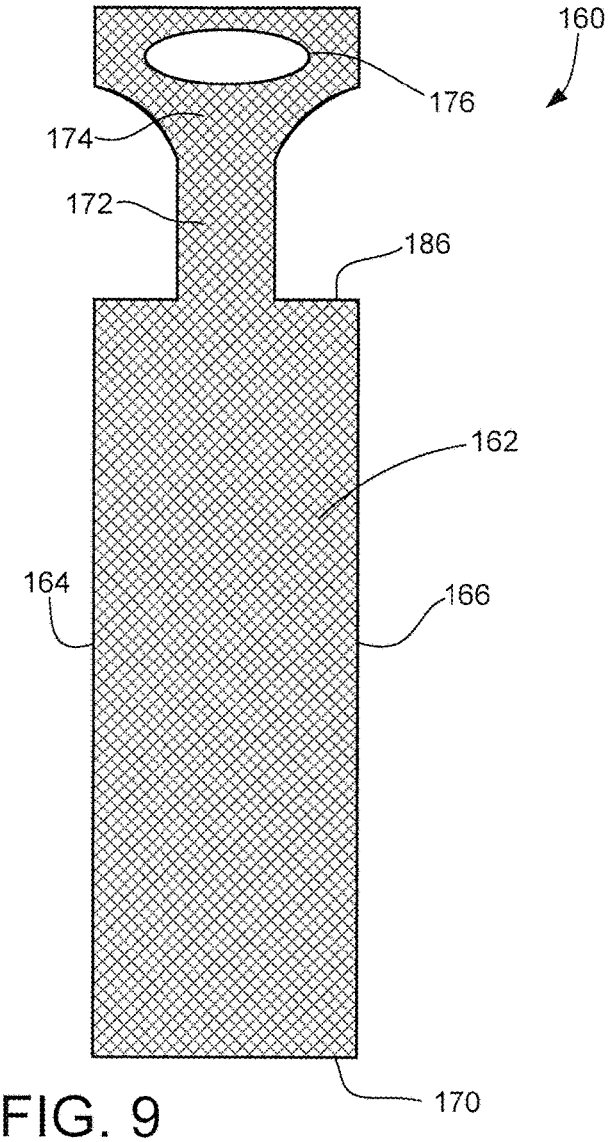
FIG. 9 shows another layer of material used to form a mooring line guard in further embodiments.

FIG. 9 shows another sheet of neoprene material 160 in accordance with further embodiments. The material may be cut from a larger sheet to provide the contoured shape illustrated in FIG. 9. The material 160 includes a substantially rectangular body portion 162 with opposing left and right side edges 164, 166 and upper and lower edges 168, 170.

An elongated strip 172 of the neoprene material extends from the upper edge 168 of the main body portion 162 and terminates in a substantially rectangular attachment portion 174 with an aperture 176 extending therethrough. The aperture 176 is shown to be substantially oval in shape, but any suitable shape can be used. As desired, reinforced backing material (not shown) can be affixed to the elongated strip 172 and/or the attachment portion 174. The strip 172 and attachment portion 174 form an integrated securement strap 178 similar to the securement straps discussed above.

Figure 10:
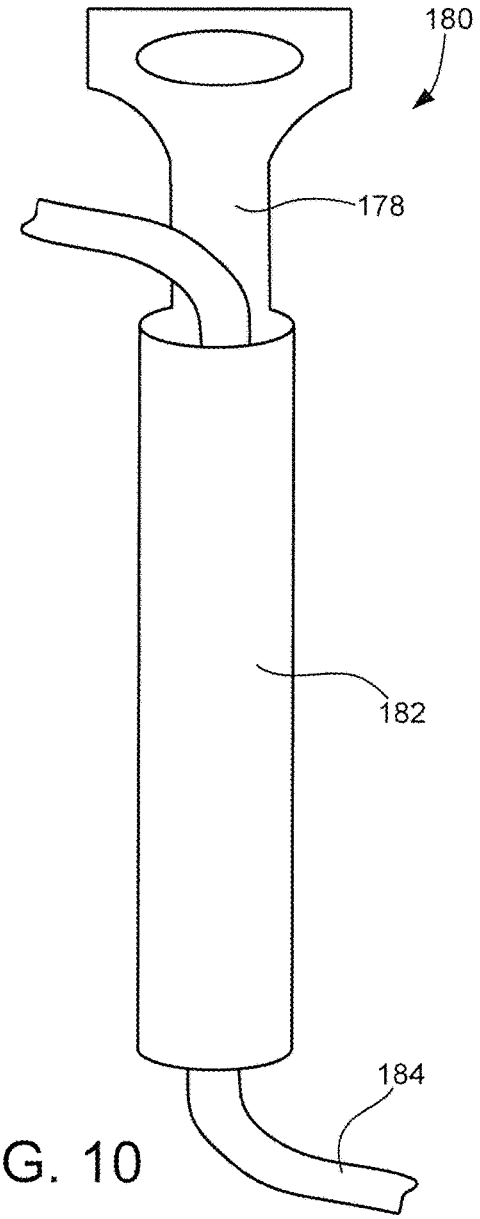

FIG. 10 shows a completed guard assembly 180 formed by rolling together and adjoining the opposing left and right side edges 166, 168 to form an elongated tube 182, as described above in FIG. 5. The tube 182 accommodates sliding movement of a mooring line 184. The tube 182 and securement strap 178 are formed from a unitary piece of material (e.g., the sheet of neoprene material 160 in FIG. 9). The relative sizes, extents and aspect ratios of the various elements of the guard assembly 180 can be adjusted as desired.

Figure 11:
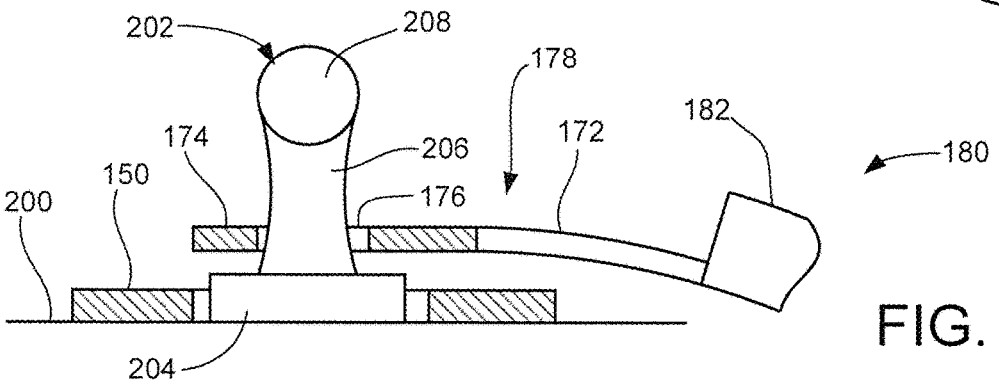
FIG. 11 is an elevational, partial cross-sectional view of the mooring line guard of FIG. 10 attached to a watercraft in some embodiments.

FIG. 11 is an elevational, partial cross-sectional view of the guard assembly 180 attached to a watercraft 200 via a mooring cleat 202. The cleat 202 is similar to the cleat 102 in FIG. 1, and is oriented so as to be viewed in FIG. 11 from one end (e.g., 90 degrees from the side view of the cleat 102 in FIG. 1).

The cleat 202 includes a base 204, a narrow medial portion 206 and horns 208 which extend from the medial portion 204 as in FIG. 1. The guard assembly 180 can be attached to the cleat 202 by stretching the fabric material of the attachment portion 176 and passing the horns 208 through the aperture 178. In this way, the medial portion 206 of the cleat 200 extends through the aperture 178 and the guard assembly 180 will be securely affixed to the cleat. The mooring line 184 from FIG. 10 is not shown in FIG. 11, but it will be understood the line will pass around the medial portion 206 of the cleat 202 and through the tube 182. FIG. 11 also shows a cross sectional view of the mat 150 from FIG. 8 which has been placed on the top surface of the watercraft 200 to surround the cleat 202.

It will now be understood that the various embodiments disclosed herein provide a number of benefits over the existing art. The guard assembly is configured to be separately attachable to a cleat or other attachment point on a watercraft, allowing the mooring line to freely slide therethrough during a mooring operation. Since the tube is not affixed to the mooring line, the medial portion of the tube will be sized and placed to effectively cover the side edge of the watercraft irrespective of adjustments made to the line. Moreover, to the extent that the watercraft shifts position or the mooring line changes angle, etc., the tube will remain substantially at the same radial distance from the cleat and remain interposed between the edge of the watercraft and the line.

The various embodiments contemplate that the tube remains permanently affixed in a closed position. A solid seamless material can therefore be used in other embodiments to form the tube. However, attachment mechanisms such as hook and loop fasteners, rivets, buttons, laces, ties, snaps, etc. can be used in other embodiments in which it is desirable to wrap and secure the tube around the mooring line. In these alternative configurations, the tube may take the form as generally set forth in FIG. 4 or 9, after which the mooring line is laid along the middle of the material and the opposing ends are brought together to form the tube.

Various changes and improvements will readily occur to the skilled artisan in view of the present disclosure, and such are encompassed by the spirit and scope of the following claims.

What is claimed is:

1. A chafe guard assembly for reducing chafing between a mooring line and an edge surface of a watercraft, comprising:

a tube characterized as an elongated tube of flexible material having opposing proximal and distal ends and an innermost diameter sized to accommodate passage of a first end of the mooring line therethrough; and a securement strap extending from the proximal end of the tube configured for contacting attachment to an attachment point of the watercraft, the securement strap having a length selected to locate a medial portion of the tube in contacting engagement with the edge surface of the watercraft to reduce wear upon the edge surface by the mooring line responsive to attachment of the first end of the mooring line to the attachment point and attachment of an opposing second end of the mooring line to a fixed support structure adjacent the watercraft, the tube and securement strap further configured to not be separately attached to the mooring line to allow the mooring line to freely slide through the tube and past the securement strap while the securement strap is affixed to the attachment point of the watercraft.

2. The chafe guard assembly of claim 1, wherein the securement strap passes through at least one aperture extending through the tube at the proximal end thereof.

3. The chafe guard assembly of claim 2, wherein the securement strap is formed of paracord.

4. The chafe guard assembly of claim 1, wherein the securement strap is adjustable in length to facilitate positioning of the medial portion of the tube against the edge surface of the watercraft.

5. The chafe guard assembly of claim 1 formed of a unitary piece of material having a substantially rectangular main body portion with opposing side edges, a top edge and a bottom edge, the opposing side edges joined to form the tube, the piece of material further comprising an elongated strip that extends from the top edge of the main body portion and which terminates in an attachment portion having a central aperture extending therethrough, the securement strap formed from the elongated strip and the attachment portion as an integrated securement strap.

6. The chafe guard assembly of claim 1, further comprising a grommet that extends through the proximal end of the tube.

7. The chafe guard assembly of claim 5, wherein the tube is formed of a first material, and the tube further comprises a reinforcement layer adjacent the first material so that the grommet passes through both the first material and the reinforcement layer.

8. The chafe guard assembly of claim 1, wherein the tube is formed of neoprene which is sewn to form a seam along the length thereof.

9. The chafe guard assembly of claim 1, further comprising a securement member which secures opposing ends of a cord of the securement strap.

10. The chafe guard assembly of claim 1, wherein the tube is formed of polychloroprene.

11. The chafe guard assembly of claim 1, in combination with the mooring line, wherein the mooring line extends through the tube without being attached to the guard assembly.

12. A chafe guard apparatus comprising:

a mooring line configured to moor a watercraft to a fixed support structure, the mooring line having a first end configured for attachment to a cleat of the watercraft and an opposing second end configured for attachment to the fixed support structure;

a tube characterized as an elongated tube of flexible material configured for sliding passage of the mooring line therethrough; and a securement strap which extends from a proximal end of the tube and which is configured for attachment to the cleat of the watercraft, the tube and the securement strap each not separately attached to the mooring line.

13. The chafe guard apparatus of claim 12, wherein the securement strap is adjustable in length to facilitate positioning of a medial portion of the tube against an edge surface of the watercraft.

14. The chafe guard apparatus of claim 12, wherein the tube and the securement strap are formed of a unitary piece of material having a substantially rectangular main body portion with opposing side edges, a top edge and a bottom edge, the opposing side edges joined to form the tube, the piece of material further comprising an elongated strip that extends from the top edge of the main body portion and which terminates in an attachment portion having a central aperture extending therethrough and sized to fit over the cleat of the watercraft, the securement strap formed from the elongated strip and the attachment portion as an integrated securement strap.

15. The chafe guard apparatus of claim 12, wherein the tube is formed of neoprene which is sewn to form a seam along the length thereof.

16. The chafe guard apparatus of claim 12, further comprising a mooring line which freely extends through the tube without being attached to the guard assembly.

17. A method for mooring a watercraft to a dock, comprising:

providing a chafe guard assembly having an elongated tube of flexible material and a securement strap which extends from a proximal end of the tube;

passing a mooring line through the tube, the mooring line having opposing first and second ends and a medial portion freely slidable within the tube; and attaching each of the securement strap to a cleat of the watercraft, the first end of the mooring line to the cleat of the watercraft, and the second end of the mooring line to an attachment point associated with the dock so that a medial portion of the tube contactingly extends between the mooring line and an edge surface of the watercraft, the securement strap and the tube not separately attached to the mooring line to allow the mooring line to freely pass through the tube and past the securement strap while the securement strap remains affixed to the cleat.

18. The method of claim 17, further comprising adjusting a length of the securement strap relative to a distance between the cleat and the edge surface of the watercraft to interpose the medial portion of the tube between the mooring line and the edge surface of the watercraft.

19. The method of claim 17, further comprising subsequently unmooring the watercraft from the dock by detaching the second end of the mooring line from the attachment point while maintaining attachment of the securement strap and the first end of the mooring line to the cleat of the watercraft.

20. The method of claim 17, further comprising a step of placing a protective mat on a deck surface of the watercraft, the mat having a central aperture through which the cleat of the watercraft extends, wherein the mat is disposed between the deck surface and the securement strap upon attachment of the securement strap to the cleat.

* * * * *